US006250893B1

(12) United States Patent
Streicher

(10) Patent No.: US 6,250,893 B1
(45) Date of Patent: Jun. 26, 2001

(54) RADIAL PISTON PUMP FOR FEEDING HIGH-PRESSURE FUEL SUPPLY

(75) Inventor: Bernd Streicher, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/355,756

(22) PCT Filed: Nov. 12, 1998

(86) PCT No.: PCT/DE98/03321

§ 371 Date: Aug. 3, 1999

§ 102(e) Date: Aug. 3, 1999

(87) PCT Pub. No.: WO99/28625

PCT Pub. Date: Jun. 10, 1999

(30) Foreign Application Priority Data

Dec. 3, 1997 (DE) ..... 197 53 593

(51) Int. Cl.[7] ..... F04B 1/04
(52) U.S. Cl. ..... 417/273; 417/470
(58) Field of Search ..... 417/273, 269, 417/266, 470; 92/129, 12.1

(56) References Cited

U.S. PATENT DOCUMENTS 4,430,047 * 2/1984 Ilg ..... 417/273
4,913,628 * 4/1990 Samland et al. ..... 417/273
4,952,121 * 8/1990 De Matthaeis et al. ..... 417/273
5,630,708 * 5/1997 Kushida et al. ..... 417/273
5,716,198 * 2/1998 Hiltemann et al. ..... 417/273
5,752,430 * 5/1998 Kawajiri et al. ..... 92/129
5,823,091 * 10/1998 Collingborn ..... 92/59
5,876,186 * 3/1999 Stiefel ..... 417/273
5,979,297 * 11/1999 Ricco ..... 92/129

FOREIGN PATENT DOCUMENTS 38 04 025 C2 6/1991 (DE) .
44 01 074 A1 7/1995 (DE) .
1 95 49 108 A1 7/1997 (DE) .
WO 86/00667 1/1996 (WO) .

* cited by examiner

*Primary Examiner*—Charles G. Freay
(74) *Attorney, Agent, or Firm*—Ronald E. Greigg; Edwin E. Greigg

(57) ABSTRACT

A radial piston pump for a high-pressure fuel supply in fuel injection systems of internal combustion engines, in particular in a common rail injection system, having a drive shaft which is supported in a pump housing and is embodied eccentrically or has cam-like protrusions in the circumferential direction. A plurality of pistons are disposed radially in given cylinder chambers relative to the drive shaft (4), and the pistons are movable radially back and forth in the respective cylinder chamber by rotation of the drive shaft. In carrying out the invention, a transverse force absorbing device is disposed between each piston and the drive shaft. This has the advantage that only forces in the longitudinal direction are brought to bear on the pistons. This means that virtually no moments act on the pistons.

10 Claims, 4 Drawing Sheets

RADIAL PISTON PUMP FOR FEEDING HIGH-PRESSURE FUEL SUPPLY

PRIOR ART

The invention relates to a radial piston pump for a high-pressure fuel supply in fuel injection systems of internal combustion engines, in particular in a common rail injection system. A drive shaft which is supported in a pump housing and is embodied eccentrically or has cam-like protrusions in the circumferential direction, and having a plurality of pistons, disposed radially in a given cylinder chamber relative to the drive shaft, are movable radially back and forth by rotation of the drive shaft in the respective cylinder chamber.

However, it should be noted that the present invention can be employed not only in a radial piston pump but also in high-pressure pumps, especially with demand-based quantity regulation.

In an internally supported radial piston pump of the type referred to at the outset, the base of each of the pistons has contact with the drive shaft. The pistons are set successively into a reciprocating motion by the eccentricity of the drive shaft or by the cam-like protrusions on the drive shaft. However, the rotating drive shaft exerts not only forces in the radial direction relative to the drive shaft on the pistons, or in other words in the longitudinal direction of the pistons, but also transversely to the pistons. These transverse forces generate a moment on the respective piston.

Within the scope of the present invention, it has been found that the piston base, which has contact with the drive shaft or with a ring disposed between the drive shaft and the piston base, was damaged during operation. This was particularly true for a piston whose base is formed by a plate that is secured to the piston by a cage and is pressed against the ring by a spring. In this particular piston, breakage of the cage occurred frequently. The damage to the piston base occurred to an increased extent when the cylinder chambers were partly filled. The damage to the piston base is disadvantageous because proper operation of the radial piston pump is no longer assured if the piston base or especially the cage breaks.

It is therefore the object of the invention to furnish a radial piston pump which overcomes the above-discussed disadvantages. In particular, damage to the piston base, such as cage breakage, is to be prevented, so that proper operation of the radial piston pump is assured even under partial filling conditions. The radial piston pump of the invention should withstand a pump pressure of up to 2000 bar.

This object is attained by the radial piston pump disclosed hereinafter. Particular types of embodiment of the invention also are disclosed.

A radial piston pump for high-pressure fuel supply in fuel injection systems of internal combustion engines, in particular in a common rail injection system. The piston pump has a drive shaft which is supported in a pump housing and is embodied eccentrically or has cam-like protrusions in the circumferential direction. Further a plurality of pistons, are disposed radially in a given cylinder chamber relative to the drive shaft, which are movable radially back and forth by rotation of the drive shaft in the respective cylinder chamber. The above object is attained in that one transverse force absorbing device is disposed between each piston and the drive shaft. The damage to the piston base is caused by the moments acting on the pistons. The transverse force absorbing device absorbs the forces acting crosswise to the pistons. This has the advantage that only forces in the longitudinal direction are now brought to bear on the pistons. This means that practically no moments act on the pistons. This reduces the load exerted by the drive shaft on the pistons considerably. Thus even at peak pressures of up to 2000 bar, a long service life of the pistons is assured.

One special type of embodiment of the invention is characterized in that the transverse force absorbing device is movable back and forth in the same direction as the associated piston. This assures that forces in the radial direction from the drive shaft, that is, in the longitudinal direction of the pistons, can be output to the pistons to the transverse force absorbing device. This assures the reciprocating motion of the pistons of the radial piston pump that is necessary for pump operation.

A further particular type of embodiment of the invention is characterized in that the transverse force absorbing device is guided in a respective bore in the housing that extends in the same direction as the associated cylinder chamber. The guidance, even at high pump pressures and rapid load changes, makes a reciprocating motion of the transverse force absorbing device possible. In particular, canting of the transverse force absorbing device in the cylinder chamber is averted.

A further particular type of embodiment of the invention is characterized in that the transverse force absorbing device is a cup tappet with a cup-shaped body. Within the scope of the present invention it has been found that a cup tappet is especially highly suitable for absorbing the transverse forces. Other forms that perform the same function are equally conceivable.

A further particular type of embodiment of the invention is characterized in that the bottom of the cup tappet is formed by a force absorbing plate. The force absorbing plate is in contact with the drive shaft and can have a variable thickness, depending on the load. The surface of the force absorbing plate can be especially treated, in order to assure high wear resistance.

A further particular type of embodiment of the invention is characterized in that the force absorbing plate is connected to a guide ring by the cup-shaped body. The guide ring slides in the cylinder chamber. The face in contact with the cylinder chamber can be especially treated, to minimize the frictional forces. The guide ring assures that the transverse force absorbing device will not become canted in the cylinder chamber. The dimensions of the guide ring depend on the pump pressure and on the number of load changes per unit of time.

A further particular type of embodiment of the invention is characterized in that a plurality of openings are provided in the cup-shaped body. The openings serve the purpose of pressure equalization and assure that even if the full stroke is utilized, there will be only a minimal pressure difference between the chamber surrounding the drive shaft and the respective cylinder chamber. As a result, the increase in Hertzian stress in the useful stroke remains slight, and in the intake stroke, complete filling of the element is assured.

A further particular type of embodiment of the invention is characterized in that the pistons are each pressed by a spring against the associated force absorbing plate of the cup tappet. By means of the spring force, the piston is moved toward the drive shaft, so that fuel is aspirated. It is also possible for the force absorbing plate of the cup tappet to be pressed against the drive shaft by a spring. In that case, however, it would be necessary for the force absorbing plate to be connected to the piston, to assure the aspiration of fuel. If the piston is acted upon directly by the spring force, then this connection between the force absorbing plate and the piston can be omitted. This variant has the advantage that a radial piston pump designed in this way can be produced simply and economically. Also in this variant, it is readily possible to apply the present invention to known radial piston pumps.

A further particular type of embodiment of the invention is characterized in that the force absorbing plate is embodied in slightly crowned fashion on the side oriented toward the drive shaft. The convex embodiment of the force absorbing plate serves to reduce the area of contact between the drive shaft and the force absorbing plate. This advantageously reduces the moment brought to bear on the cup tappet by the drive shaft. In the design of the force absorbing plate, the elastic deformation of the cup tappet must be taken into the account.

A further particular type of embodiment of the invention is characterized in that a ring is disposed between the drive shaft and the cup tappets. The ring serves to transmit forces from the drive shaft to the force absorbing plate. The ring is advantageously supported slidingly on the drive shaft. The ring may be embodied either cylindrically or polygonally.

The present invention has the advantage in general that the radial piston pump can be made simply and economically. Furthermore, the fundamental concept of the present invention can be applied in a simple way to existing radial piston pumps, for instance by replacing a tappet plate provided on the piston with a cup tappet. The component strength, especially during a zero pumping phase in the intake stroke, is also increased.

Further advantages, characteristics and details of the invention will become apparent from the ensuing description, in which an exemplary embodiment is described in detail in conjunction with the drawings.

The characteristics recited in the claims and in the description can each be essential to the invention individually or in arbitrary combination. One way of embodying the claimed invention is described in detail below in conjunction with the drawings.

DETAILED DESCRIPTION

Figure 1:
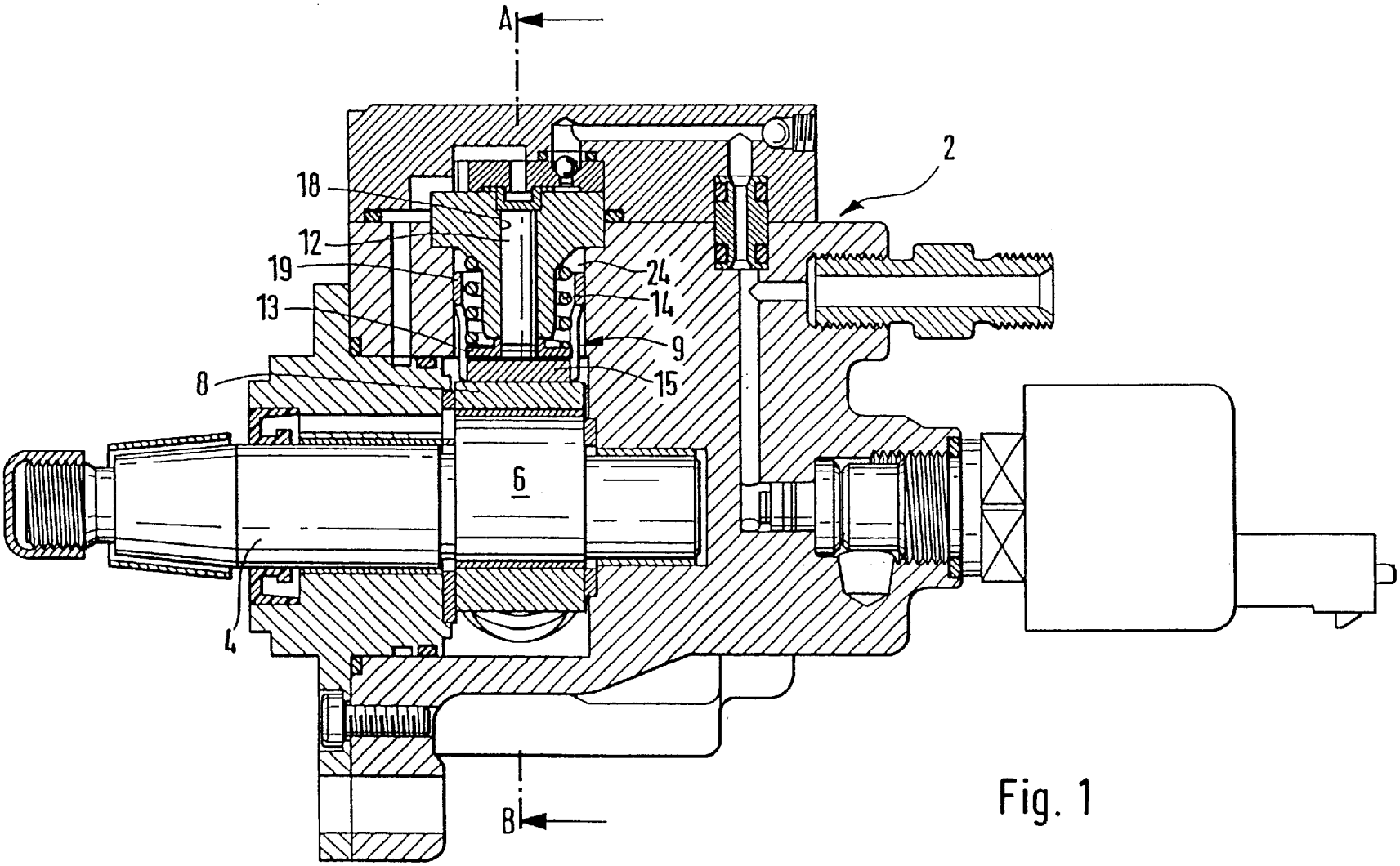
FIG. 1 shows a sectional view of a radial piston pump of the invention.
Figure 2:
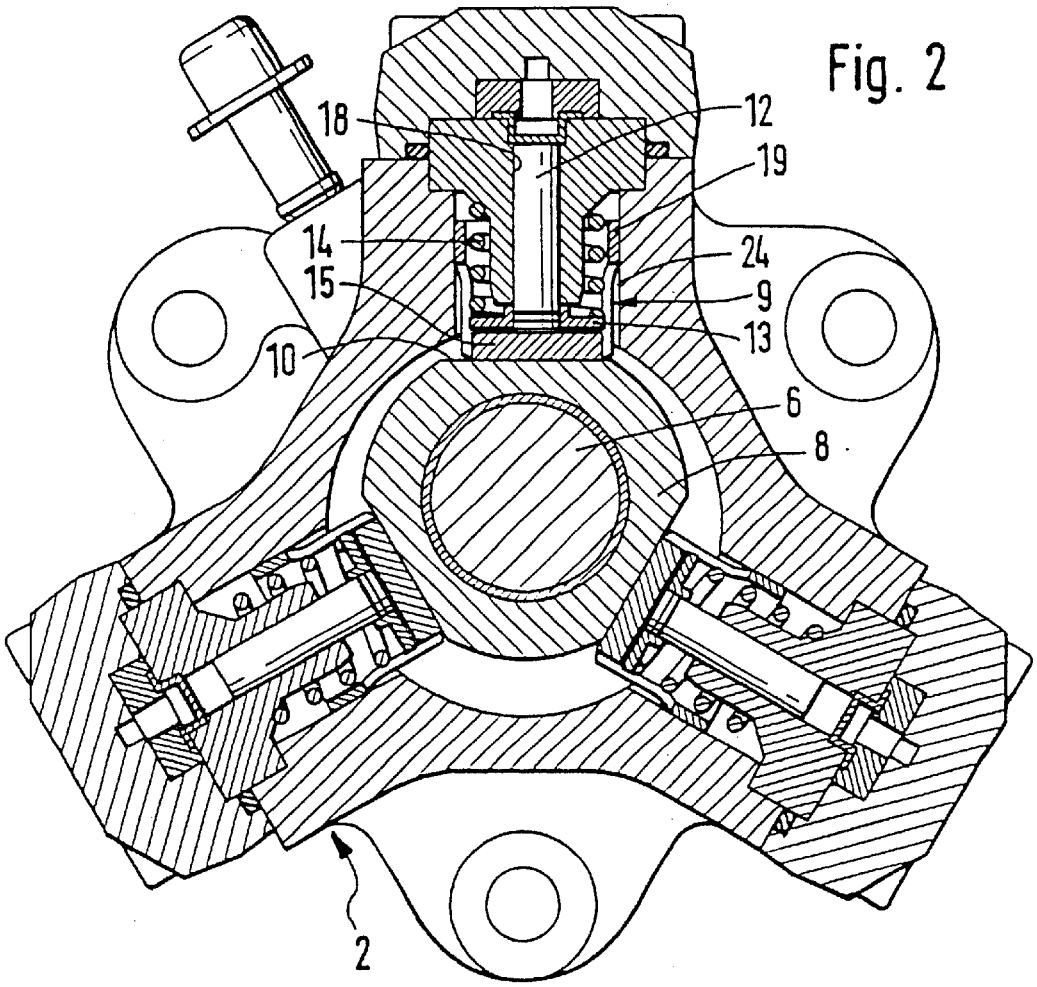
FIG. 2 is a section taken along the line A–B through the radial piston pump of FIG. 1.

FIGS. 1 and 2 show a radial piston pump for high-pressure fuel supply in fuel injection systems of internal combustion engines. The radial piston pump is equipped with demand-based quantity regulation. The fuel delivery and dimensioning are effected via a metering unit, not shown.

The radial piston pump of the invention is used in particular in common rail injection systems for supplying fuel to Diesel engines. The term "common rail" means the same as "common line". In contrast to conventional high-pressure injection systems, in which the fuel is fed to the individual cylinder chambers via separate lines, in common rail injection systems the injection nozzles are supplied from a common line.

The radial piston pump shown in FIGS. 1 and 2 includes a drive shaft 4, supported in a pump housing 2 and having an eccentrically embodied shaft segment 6. A ring 8 is provided on the eccentric shaft segment 6, and the shaft segment 6 is rotatable relative to the ring. The ring 8 includes three flat faces 10, offset from one another by 120° each, and one piston 12 is braced against each of the flat faces. The pistons 12 are each received in a cylinder chamber 18 in a manner capable of reciprocation in the radial direction relative to the drive shaft 4.

On the end of each of the pistons 12 oriented toward the drive shaft 4, a respective spring plate 13 is secured, against which a spring 14 is prestressed. The spring 14 presses the piston 12 against a force absorbing plate 15, which belongs to a cup tappet that is shown larger, on a scale of 2:1 in FIGS. 3 and 4.

Figure 3:
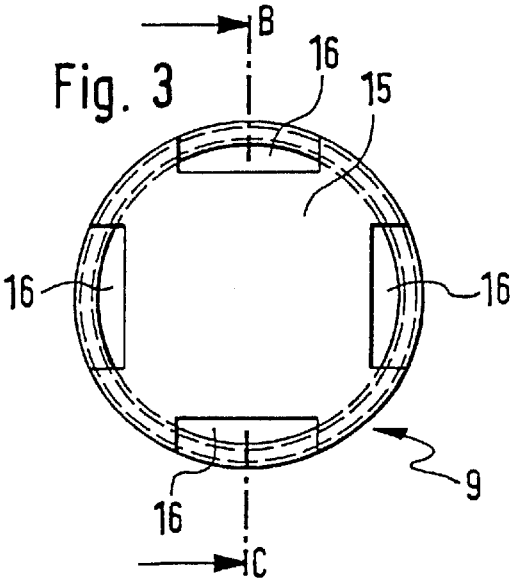
FIG. 3 shows a view from below of a cup tappet of the invention.
Figure 4:
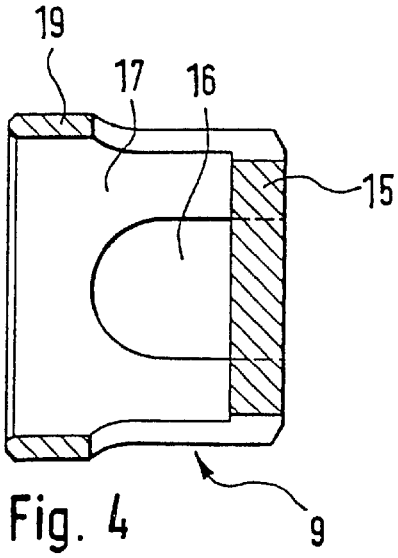
FIG. 4 is a section through the cup tappet of FIG. 3 taken along the line B–C.

In the view from below in FIG. 3, it can be seen that the force absorbing plate 15 takes the form of a round disk, over whose circumference four rectangular recesses are distributed uniformly. As best seen from FIG. 4, the force absorbing plate 15 is connected to a guide ring 19 by a cup-shaped body 17. The openings 16 each extend from the force absorbing plate 15 into the cup-shaped body 17. The size of the openings 16 is selected such that as the cup tappet 9 moves back and fourth, a pressure equalization takes place between the chamber in which the ring 8 is disposed and the chamber in which the spring 14 is disposed. The openings 16 assure that the pressure difference between these aforementioned chambers is minimal in all operating states. As a result, the increase in Hertzian stress in the useful stroke of the piston 12 remains slight, while in the intake stroke, given a suitably designed spring 14, complete filling of the respective cylinder chamber 18 is assured. Without the openings 16, the movement back and forth of the cup tappet would be more difficult or even impossible.

In FIG. 1, it is shown that the force absorbing plates 15 are in contact with the flat faces 10 of the ring 8. The ring 8 is slidingly supported on the drive shaft 4 and upon a rotation of the drive shaft 4 is set into motion by the eccentrically embodied shaft segment 6. However, this motion has not only a radial component relative to the drive shaft 4, which is required for the piston stroke, but also a component in the circumferential direction of the drive shaft 4, or in other words, transversely to the pistons 12. This component, which corresponds to the aforementioned transverse forces, is undesired because it exerts a moment on the pistons.

The cup tappet according to the invention absorbs the forces in the circumferential direction of the ring 8. The cup tappet 9, as shown in FIGS. 1 and 2, is guided in the housing 2 in a bore 24 by the guide ring 19. The bore extends in each case in the same direction as the associated cylinder chamber 18. Because the cup tappet 9 is thus braced in the housing 2, the transverse forces are conducted from the ring into the housing 2, via the force absorbing plate 15, the cup-shaped body 17, and the guide ring 19. As a result, only forces in the longitudinal direction of a respective piston are exerted on the pistons 12. This reduces the load on and wearing of the pistons 12 considerably.

Figure 5:
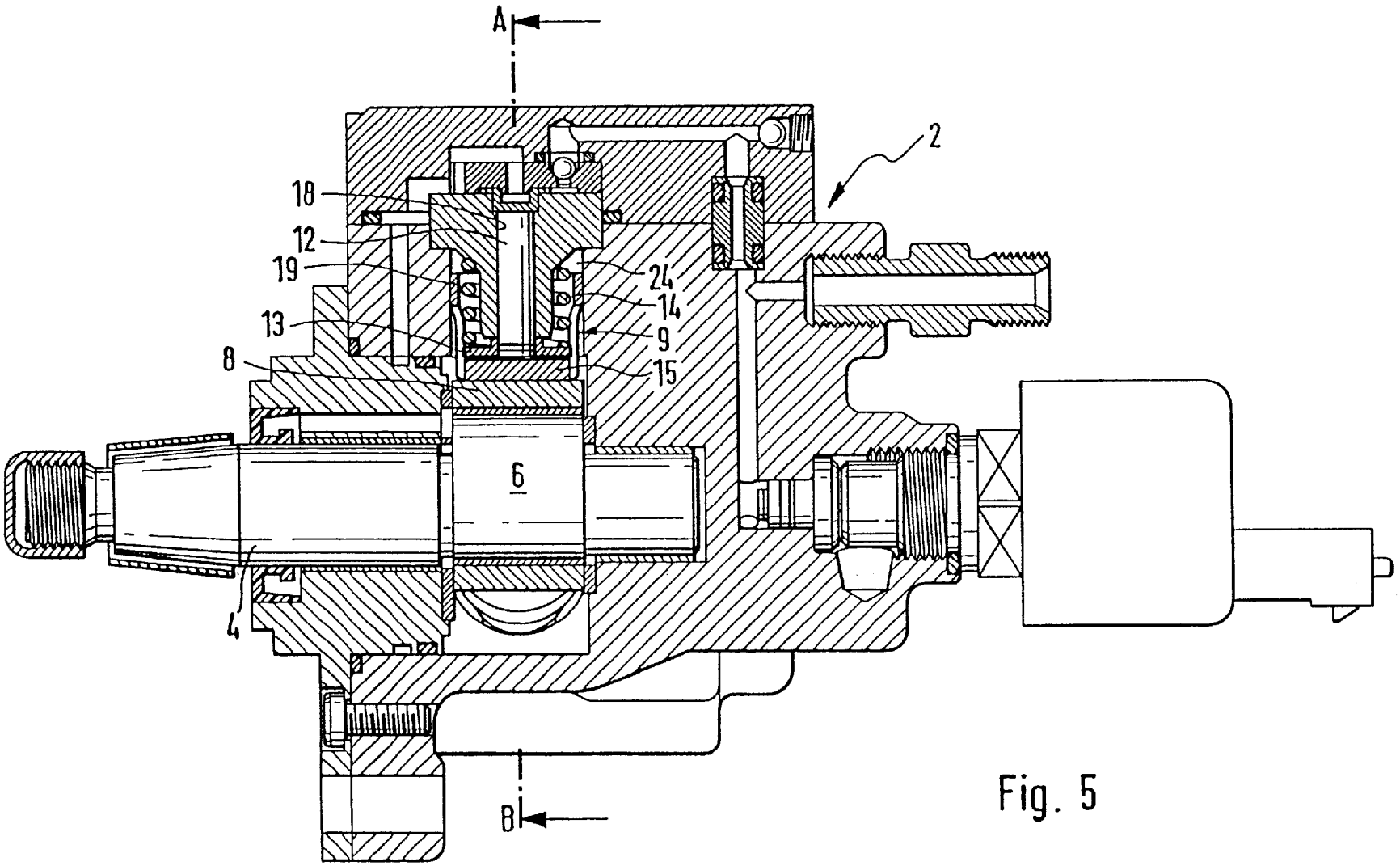
FIG. 5 is a sectional view of a further form of embodiment of the radial piston pump of the invention.
Figure 6:
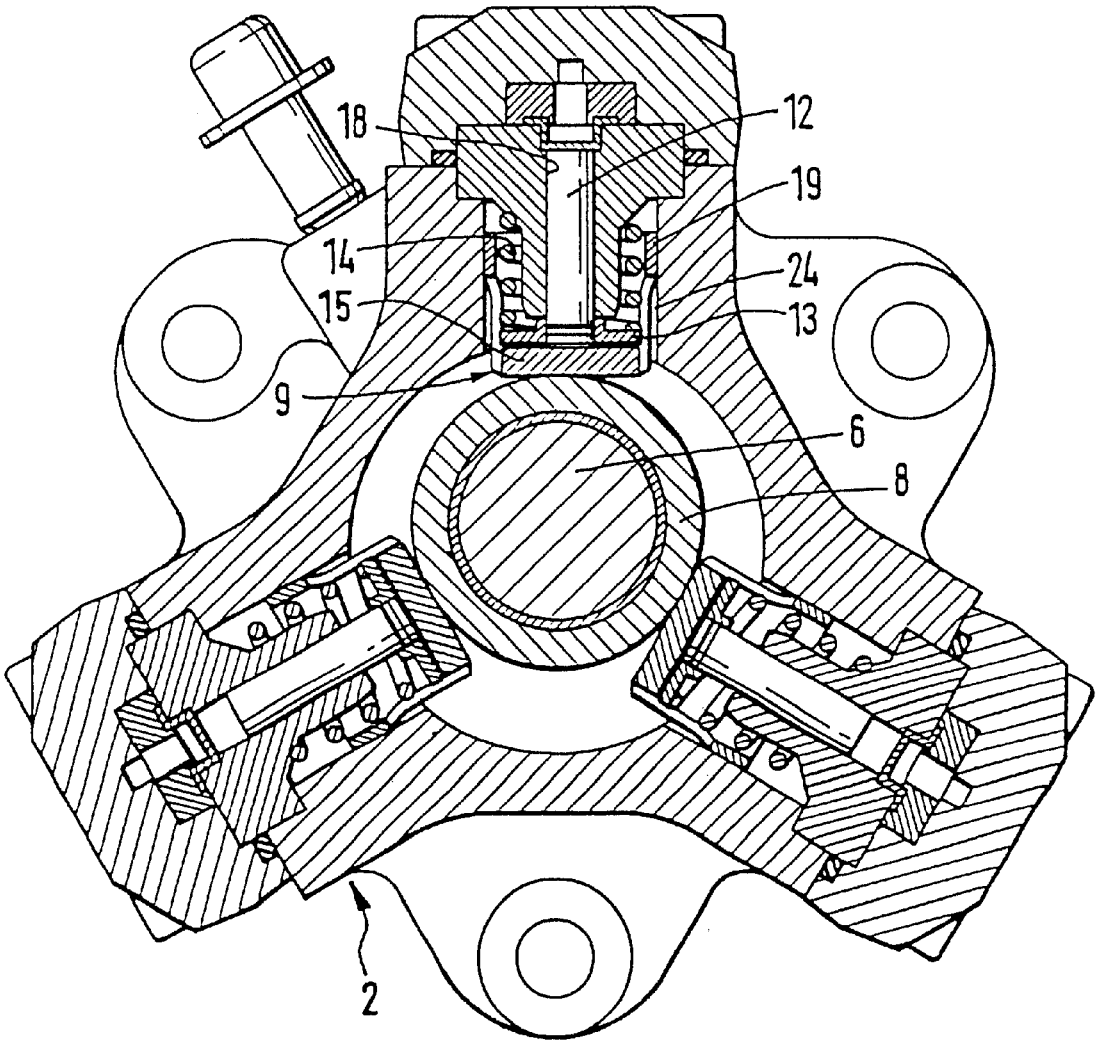
FIG. 6 shows a section taken along the line A–B through the radial piston pump of FIG. 5.

The radial piston pump shown in FIGS. 5 and 6 is maximally equivalent to the form of embodiment shown in FIGS. 1 and 2. For elements that are included in both the radial piston pump of FIGS. 1 and 2 and that of FIGS. 5 and 6, the same reference numerals are therefore used. To avoid repetition, those parts will not be described again in the description of FIGS. 5 and 6.

The primary distinction between the form of embodiment of FIGS. 5 and 6 and the form of embodiment of FIGS. 1 and 2 is that the ring 8, in the radial piston pump shown in FIGS. 5 and 6, is not in the form of a polygon but rather is cylindrical. In both forms of embodiment, the cup tappet 9 is the same and is equivalent to the cup tappet 9 that is shown enlarged in FIGS. 3 and 4.

The foregoing relates to a preferred exemplary embodiments of the invention, it being understood that other variants and embodiments thereof are possible within the spirit and scope of the invention, the latter being defined by the appended claims.

What is claimed is:

1. A radial piston pump for a high-pressure fuel supply in fuel injection systems of internal combustion engines in a common rail injection system, comprising a drive shaft (4) which is supported in a pump housing (2) and is embodied eccentrically or has cam-like protrusions in the circumferential direction, a plurality of pistons (12), disposed radially in a given cylinder chamber (18) relative to the drive shaft (4) for movement radially back and forth in the given cylinder chamber (18) by rotation of the drive shaft (4), one transverse force absorbing device (9) is disposed between each piston (12) and the drive shaft (4), the transverse force absorbing device (9) is a cup tappet with a cup-shaped body (17), the bottom of the cup tappet (9) is formed by a force absorbing plate (15), and the force absorbing plate (15) is connected to a guide ring (19) by the cup-shaped body (17).

2. The radial piston pump according to claim 1, in which the transverse force absorbing device (9) is movably disposed for back and forth movement in the bore (24) in a same direction as an associated piston (12).

3. The radial piston pump according to claim 2, in which the transverse force absorbing device (9) is guided for movement in a respective bore (24) in the housing (2) in which the respective bore extends in a same direction as the associated cylinder chamber (18).

4. The radial piston pump according to claim 1, in which a plurality of openings (16) are provided in the cup-shaped body (17).

5. The radial piston pump according to claim 4, in which the pistons (12) are each pressed by a spring (14) against the associated force absorbing plate (15) of the cup tappet (9).

6. The radial piston pump according to claim 4, in which the force absorbing plate (15) is embodied in slightly crowned fashion on a side oriented toward the drive shaft (4).

7. The radial piston pump according to claim 1, in which the pistons (12) are each pressed by a spring (14) against the associated force absorbing plate (15) of the cup tappet (9).

8. The radial piston pump according to claim 7, in which the force absorbing plate (15) is embodied in slightly crowned fashion on a side oriented toward the drive shaft (4).

9. The radial piston pump according to claim 1, in which the force absorbing plate (15) is embodied in slightly crowned fashion on a side oriented toward the drive shaft (4).

10. The radial piston pump according to claim 1, in which a ring (8) is disposed between the drive shaft (4) and the cup tappets (9).

* * * * *

UNITED STATES PATENT AND TRADEMARK OFFICE

CERTIFICATE OF CORRECTION

PATENT NO. : 6,250,893 B1
DATED : June 26, 2001
INVENTOR(S) : Bernd Streicher

It is certified that error appears in the above-identified patent and that said Letters Patent is hereby corrected as shown below:

Title page,
Item [54], should read as follows:
[54] RADIAL PISTON PUMP FOR HIGH-PRESSURE FUEL SUPPLY Signed and Sealed this Eleventh Day of December, 2001

*Attest:*

Nicholas P. Godici

*Attesting Officer*

NICHOLAS P. GODICI
*Acting Director of the United States Patent and Trademark Office*